US005201357A

United States Patent [19]

Kuhn et al.

[11] Patent Number: 5,201,357

[45] Date of Patent: Apr. 13, 1993

[54] METHOD FOR FORMING CORED PASSAGEWAYS WITHIN CAST METAL ARTICLES

[75] Inventors: John W. Kuhn, Bristol; Richard J. Wylie, Wabash, both of Ind.

[73] Assignee: CMI International, Inc., Southfield, Mich.

[21] Appl. No.: 821,225

[22] Filed: Jan. 16, 1992

[51] Int. Cl.[5] ..... B22D 29/00

[52] U.S. Cl. ..... 164/132; 164/365

[58] Field of Search ..... 164/132, 365

[56] References Cited

U.S. PATENT DOCUMENTS

| | | | |
|---|---|---|---|
| 818,413 | 4/1906 | Caldwell | 164/397 |
| 1,310,768 | 7/1919 | Nugent | 164/35 |
| 1,416,412 | 5/1922 | Pack | 164/14 |
| 1,864,451 | 6/1932 | Lüngen | 164/396 |
| 2,045,556 | 6/1936 | Almen . | |
| 2,173,955 | 9/1939 | Zahn . | |
| 2,304,879 | 12/1942 | Brazil . | |
| 2,362,875 | 11/1944 | Zahn . | |
| 2,688,781 | 9/1954 | Fahlberg et al. . | |
| 2,897,556 | 8/1959 | Chini | 164/132 |
| 2,907,084 | 10/1959 | Wood | 164/132 X |
| 2,991,520 | 7/1961 | Dalton . | |
| 4,532,974 | 8/1985 | Mills et al. | 164/132 |

FOREIGN PATENT DOCUMENTS

| | | | |
|---|---|---|---|
| 0154787 | 9/1985 | European Pat. Off. | 164/132 |
| 53-32825 | 3/1978 | Japan | 164/132 |

*Primary Examiner*—J. Reed Batten, Jr.

*Attorney, Agent, or Firm*—Reising, Ethington, Barnard, Perry & Milton

[57] ABSTRACT

A sleeve of woven heat resistant material is axially compressed (22) to enlarge its cross-sectional area and perimeter. A support element (24) is disposed within the sleeve (22) to support it in its enlarged perimeter condition (26). The sleeve-covered support element (18) is then disposed in a cavity (14) of a casting mold (12) and molten metal (36) is cast into the cavity (14) and around the sleeve-covered support element (18). The molten metal (36) is allowed to solidify to form a cast article (16). The support element (24) is then withdrawn from within the sleeve (22), leaving the sleeve (22) within and adhered to the walls of the passageway (20) of the article in the expanded perimeter condition (26). A tension force A is applied to the sleeve (22) forcing it to stretch into a smaller cross-sectional area and perimeter (28) and causing the sleeve (22) to detach from the casting (16) for easy removal.

5 Claims, 2 Drawing Sheets

METHOD FOR FORMING CORED PASSAGEWAYS WITHIN CAST METAL ARTICLES

BACKGROUND OF THE INVENTION

1. Field of the Invention

The present invention relates to a method for forming cored passageways within cast metal articles.

2. Description of the Prior Art

Cores are commonly used in connection with metal casting operations for forming spaces, such as fluid passages, within cast metal articles.

Sand cores are most often employed because of their low cost. However, the application of sand cores is limited to applications in which the length to thickness ratio of the core is fairly small. That is, sand cores having a very small cross-section and a very long length are extremely fragile and easily broken during handling and/or casting, making the use of sand cores in such applications commercially impractical.

An example of where a sand core would be unsuitable is in the formation of oil galleys within the engine block and cylinder heads of an internal combustion engine. These oil galleys are formed as very long and relatively narrow passages that extend virtually the entire length of the casting. A sand core of this configuration is much too fragile and is not commercially employed in this or similar applications.

A proposed alternative to the sand core is disclosed in the U.S. Pat. No. 2,991,520 to Dalton, granted Jul. 11, 1961. This patent suggests using a sleeve of refractory material disposed about a tube or rod as the core. Following casting, the rod is either manually removed or dissolved by an acid solution and the sleeve pulled out of the casting to leave the desired passageway. Although this method of coring should in theory work, attempts at practicing the invention as disclosed have shown that the sleeve is very difficult to remove from the resultant cast article following casting, thus rendering use of such a coring technique commercially impractical as well. In particular, it has been found that when the molten metal is cast into the cavity and around the sleeve-covered core, the molten metal has a tendency to enter the interstices of the woven sleeve. Upon solidification of the molten metal, the sleeve is thus caused to remain stuck or adhered to the cast article, making removal unacceptably difficult. Dalton, teaches that the sleeve will simply collapse inwardly following removal of the core or support element from within the sleeve, implying that the sleeve does not remain attached to the casting as was found in practice. Dalton relies on this inward collapsing for the easy removal of the sleeve. Dalton does not address the difficulties of removing a sleeve that remains attached to the passageway walls of the casting following removal of the inner core support.

Because the present coring technology precludes using cores to form long and relatively narrow passages in cast articles, the industry has turned to other and more costly alternatives.

For instance, it is common practice to rifle drill the oil galleys into cylinder blocks and heads in a separate machining operation following casting. This process is more expensive than coring and presents problems particularly with aluminum engine blocks and cylinder heads since the drilling tool tends to drift or wander as it is extended into the casting. Thus, several drilling operations are usually required to make a single oil passage and further adds to the expense of forming such passages.

Thus, there are these and numerous other applications in which coring would be the preferred way of forming a passageway within a metal casting. However, because of the present coring technology available to the industry, coring is commercially impractical and other more costly alternatives must instead be employed. Accordingly, there is a need in the industry for a coring process which may be employed in applications where a long and relatively thin core is required.

SUMMARY OF THE INVENTION AND ADVANTAGES

A method for forming cored passageways within a cast metal article includes disposing a support element within a sleeve of woven refractory material which has been axially compressed in order to enlarge its cross-sectional area and perimeter. The sleeve-covered support element is disposed within a casting cavity of a mold and molten metal cast into the cavity and around the sleeve-covered support element and allowed to solidify. The support element is then removed from within the sleeve while the sleeve remains in the enlarged condition and attached to the cast article. A tension force is then applied to the sleeve forcing it to stretch into a smaller cross-sectional area with a contracted perimeter whereby the sleeve detaches from the article for easy removal leaving behind a resultant cored passageway within the article.

One advantage of using a heat-resistant core having a changeable size cross-sectional perimeter is that it is very easy to remove the core from the cast article following casting. By constricting the perimeter of the core during removal, the outer surface of the core detaches or snaps away from the cast article and allows the core to be easily withdrawn from the cast article.

Another advantage of the subject invention is that it is commercially practical. More specifically, the subject invention provides a method for coring long and narrow passages in metal castings in a commercially practical manner. This is attributed to the easy removal of the heat resistant core from the article following casting. In this way, a higher quality, lower cost method of forming long and narrow passages within in a cast article is provided.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 7:
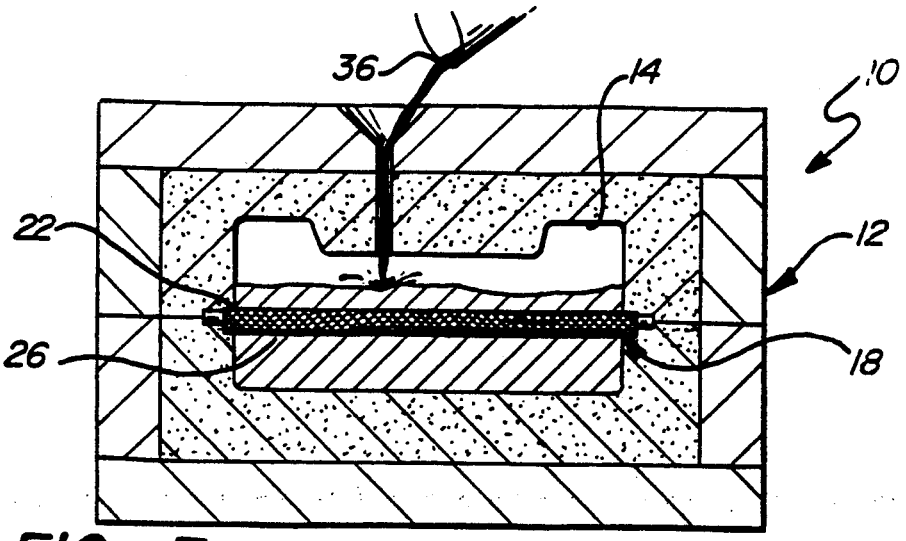
FIG. 7 is a cross-sectional view of the subject casting mold showing the core assembly disposed within the cavity of the mold.

A casting mold assembly of the present invention is generally shown at 10 in FIG. 7.

The assembly 10 comprises a casting mold 12 having an article-defining cavity (i.e., cavity walls with a size and shape of the article to be formed) 14 formed therein. The casting mold 12 may be any of a number of types well known to the industry and suited for metal casting, such as the sand mold type shown in FIG. 7. An article which has been cast within the mold 12 is shown at 16 in FIGS. 8–10. The article 16 may be formed of any of a number of metals or their alloys, such as aluminum and iron.

The mold assembly 10 includes a core, generally shown at 18, disposed within the cavity 14 of the mold 12 for preserving the space that occupies in the cavity 14 as a space or passageway 20 in the resultant cast article 16.

The core 18 comprises a sleeve of heat-resistent resistant material 22 disposed about a support element 24. The sleeve 22 is preferably formed of a plurality of refractory fibers, such as glass, which have been woven or braided into a elongated tubular sleeve or sock. A preferred sleeve material is sold under the registered trademark NATGLAS® by Natvar Company, Highway 70 East P.O. Box 658, Clayton, N.C. 27520. This material is undamaged by the casting process and the sleeve 22 is thus reusable. Thus, following casting the sleeve 22 can be extracted from the cast article 16 intact and reused.

The weaving of the sleeve 22 is such that if one axially compresses the sleeve 22 (i.e., shortens the end-to-end length of the sleeve 22), the cross-sectional area and perimeter of the sleeve 22 are caused to enlarge. This enlarged perimeter condition is shown at 26 in FIGS. 1 and 4. Similarly, if one applies a tension force along the length of the sleeve 22 (i.e., increases the end-to-end length of the sleeve 22) the cross-sectional area and perimeter are caused to contract in size. This contracted perimeter condition is illustrated in FIGS. 2 and 5 at 28. Thus, the weaving of the sleeve 22 directs axially applied forces radially outwardly or inwardly (depending on whether the axial force is a compressive force or a tension force) to either increase or decrease the cross-sectional area and perimeter of the sleeve 22 as can be seen by comparing FIGS. 4 and 5, respectfully. Thus, lengthening the sleeve 22 is accompanied by a corresponding reduction in its cross-sectional area and perimeter, whereas shortening the sleeve 22 is accompanied by a corresponding increase in its cross-sectional area and perimeter.

Figure 6:
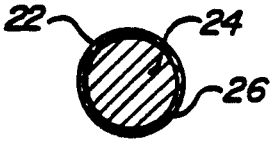
FIG. 6 is a cross-sectional view taken along line 6—6 of FIG. 3.

The support element 24 comprises a straight metal rod or similar structure which supports the sleeve 22 in the enlarged perimeter condition 26 during casting. The support element 24 has a fixed size cross-sectional perimeter which is selected to compliment the cross-sectional size of the inner surface of the sleeve 22 when in the enlarged perimeter condition 26 as shown in FIG. 6. Thus, the perimeter of the support element 24 is larger than the perimeter of the sleeve 22 when in the contracted perimeter condition 28 but substantially equal to or slightly less than the perimeter of the sleeve 22 when in the enlarged perimeter condition 26 (less the thickness of the sleeve 22). In this way, the sleeve 22 is maintained in its enlarged perimeter condition 26 about the support element 24 and presents a smooth, non-wrinkled outer surface against which molten metal can be cast.

The method of the subject invention includes first forming the casting mold 12 and the cavity 14 within the mold 12. There are a number of commercially available methods for forming casting molds and cavities which depend, in part, on the particular type of mold chosen. A sand-type mold 12 of FIG. 7 may be formed with the cavity 14 by compacting sand or other particulate material against an article-defining pattern (not shown) to form complimentary cope and drag sections of the mold 12. A pouring sprue or passage may also be provided in the cope for admitting molten metal into the cavity 14 of the mold 12. Suitable gas vents and vacuum passages may also be included, as is well known and understood to those skilled in the art, but are omitted since FIG. 7 is merely a schematic and intended to highlight the essential features of the present invention.

Figure 1:
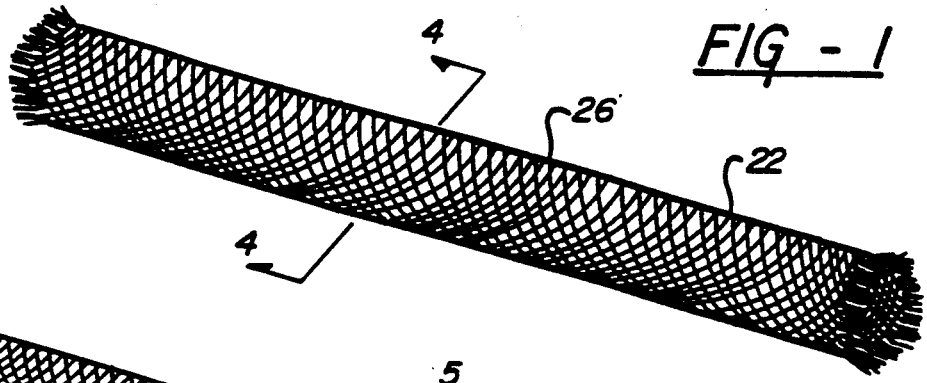
FIG. 1 is a perspective view of the sleeve in the expanded perimeter condition.
Figure 2:
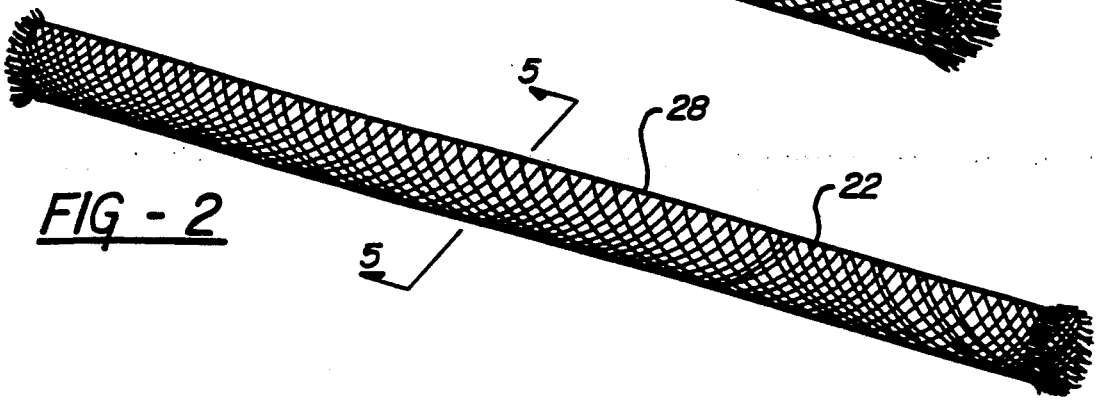
FIG. 2 is a view like FIG. 1 but showing the sleeve in the contracted perimeter condition.
Figure 3:
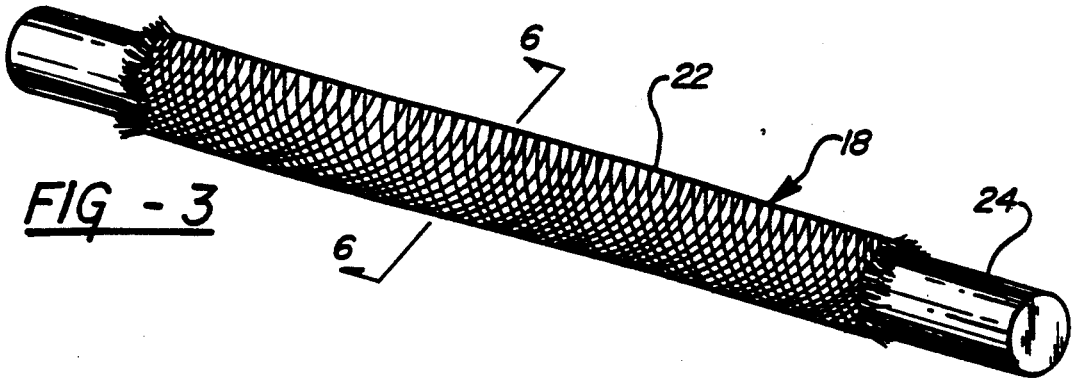
FIG. 3 is a perspective view of the sleeve disposed about the support element in the expanded perimeter condition.
Figure 4:
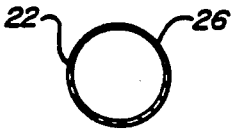
FIG. 4 is a cross-sectional view taken along lines 4—4 of FIG. 1.
Figure 5:
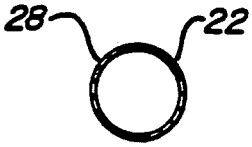
FIG. 5 is a cross-sectional view taken along line 5—5 of FIG. 2.

The next step is to obtain a piece of the heat resistant woven refractory sleeve material 22 and axially compress the sleeve 22 along its length to enlarge is cross-sectional area and perimeter as shown in FIGS. 1 and 4. Once in this enlarged perimeter condition 26, the sleeve 22 is slid over the support element 24 and the support element 24 supports the sleeve 22 in the enlarged perimeter condition 26 as shown in FIGS. 3 and 6.

The sleeve-covered support element (i.e., the core) 18 is then disposed within the cavity 14 as shown in FIG. 7 and molten article-defining metal 36 is cast into the cavity 14 and about the core assembly 18 as shown in FIG. 7. Since the sleeve 22 is woven, the molten metal 36 is caused to enter into the interstices of the woven sleeve 22 a slight amount. Upon solidification of the molten metal 36, the sleeve 22 is caused to be stuck or adhered to the resultant cast article 16 because of the slight penetration of the molten metal 36 into the interstices of the woven sleeve 22.

Figure 8:
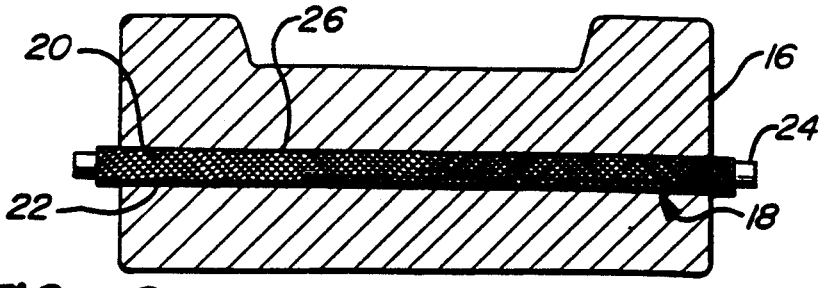
FIG. 8 is a cross-sectional view of the article cast within the mold of FIG. 7.

After the article 16 has cooled to a sufficient removal temperature, it is removed from the mold 12 with the core 18 remaining within the article 16 as shown in FIG. 8.

Figure 9:
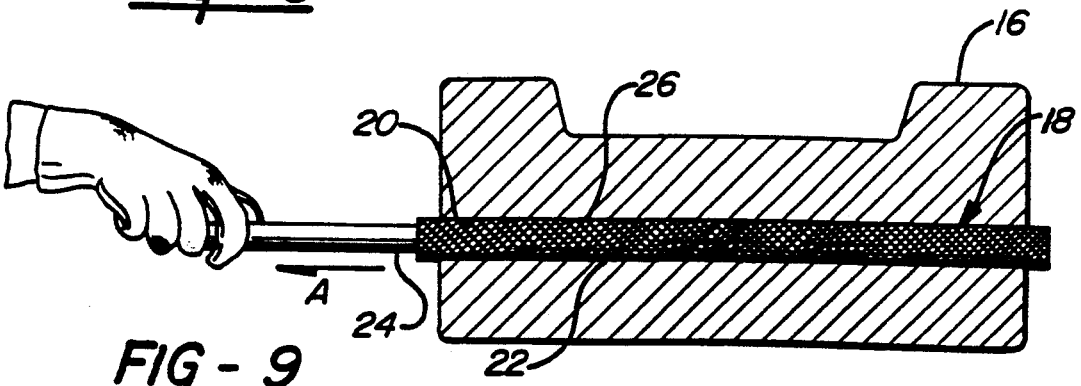
FIG. 9 is a view like FIG. 8 but showing the support element being manually withdrawn following casting.
Figure 10:
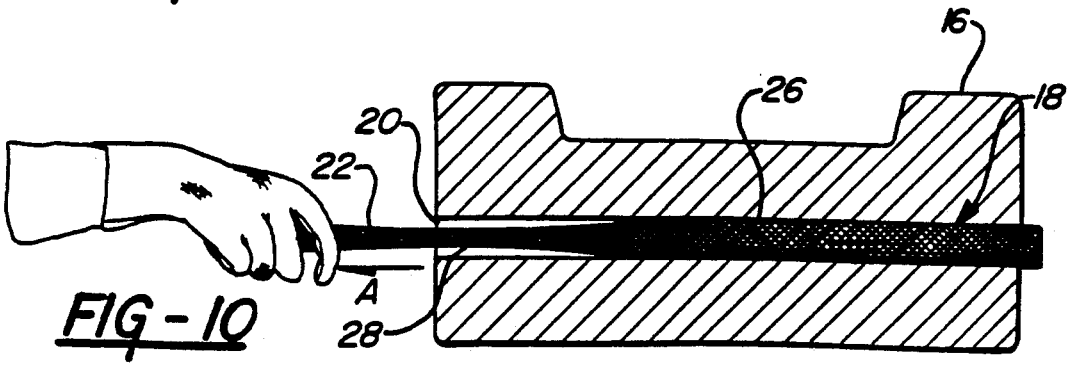
FIG. 10 is a similar view showing the sleeve being manually withdrawn from the cast article.

The first step in removing the core 18 from the article 16 is to extract the support element 24 from within the sleeve 22. With a straight metal support element 24, such as the rod shown in the figures, removal can be achieved by manually withdrawing the rod 24 by pulling along its length with a tension force, as is depicted in FIG. 9 by the arrow A. Once the support element 24 is withdrawn, the outer surface of the sleeve 22 remains stuck or engaged with the passageway wall 20 in the enlarged perimeter condition 26 due to the penetration of the molten metal 36 into the interstices of the sleeve 22 as previously described herein above.

To remove the sleeve 22 from with the passageway 20 of the article 16, it is thus necessary to disengage the outer surface of the sleeve 22 from the wall of the passageway 20. This is accomplished by applying a tension force A along the length of the sleeve 22 forcing it to stretch into a smaller cross-sectional area with a contracted perimeter (FIG. 5).

As the sleeve 22 changes from its enlarged perimeter condition 26 to the contracted perimeter condition 28, the outside surface of the sleeve 22 is caused to disengage or pull free from the passageway wall 20. In practice, a sharp tug or pulling force applied to the sleeve 22 in the manner shown in FIG. 10 causes the sleeve 22 to snap away from the passageway wall 20 and allows the sleeve 22 to be easily removed from within the cast article 16 leaving behind the resultant passageway 20. Thus, by positioning the sleeve 22 in the enlarged perimeter condition 26 prior to casting, the weaving of the sleeve 22 allows the sleeve 22 to direct the axially applied tension force A radially inwardly to contract the perimeter of the sleeve 22 and pull the sleeve 22 free from the cast article 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A method of forming a cored passageway within a cast metal article, said method comprising:

axially compressing a sleeve (22) of woven refractory material to enlarge its cross-sectional area and perimeter;

disposing a support element (24) within the sleeve (22) thereby supporting the sleeve (22) in the enlarged condition;

disposing the sleeve-covered support element (18) within a casting cavity (14) of a mold (12);

casting molten metal (36) into the cavity (14) and around the sleeve-covered support element (18) and allowing the metal (36) to solidify and form a cast article (16);

removing the support element (24) from within the sleeve (22) with the sleeve (22) remaining in the enlarged condition (26) and attached to the cast article (16); and applying a tension force (A) along the length of the sleeve (22) forcing it to stretch into a smaller cross-sectional area with a contracted perimeter whereby the sleeve (22) detaches from the article (16) for easy removal leaving behind a resultant cored passageway (20) within the article (16).

2. A method as set forth in claim 1 wherein the sleeve (22) of woven refractory material comprises a sleeve of woven fibers of glass.

3. A method as set forth in claim 2 wherein the sleeve (22) is removed from within the cast article (16) intact and undamaged for subsequent reuse.

4. A method as set forth in claim 1 wherein the support element (24) comprises a metal rod.

5. A method as set forth in claim 4 wherein the metal rod (24) is removed from within the sleeve (22) intact and undamaged for subsequent reuse.

* * * * *